United States Patent [19]

Härtel

[11] 3,982,394

[45]*Sept. 28, 1976

[54] CONTROL INSTALLATION FOR THE PROPORTIONING OF A SECONDARY AIR QUANTITY FOR ACHIEVING OPTIMUM COMBUSTION OR AFTER-BURNING IN INTERNAL COMBUSTION ENGINES

[75] Inventor: Günter Härtel, Rosellen, Germany

[73] Assignee: Deutsche Vergaser GmbH & Co. Kommanditgesellschaft, Neuss, Germany

[ * ] Notice: The portion of the term of this patent subsequent to Jan. 13, 1976, has been disclaimed.

[22] Filed: May 23, 1974

[21] Appl. No.: 472,884

[30] Foreign Application Priority Data

May 25, 1973 Germany ..... 2326718

[52] U.S. Cl. ..... 60/276; 60/290

[51] Int. Cl.[2] ..... F02B 75/10

[58] Field of Search ..... 60/290, 289, 285, 276

[56] References Cited

UNITED STATES PATENTS 3,768,259 10/1973 Carnahan ..... 60/276

3,832,848 9/1974 Scholl ..... 60/276

FOREIGN PATENTS OR APPLICATIONS 1,476,512 7/1969 Germany ..... 60/299

*Primary Examiner*—Douglas Hart

*Attorney, Agent, or Firm*—Haseltine, Lake & Waters

[57] ABSTRACT

A control installation for the proportioning of a secondary air quantity employed for achieving optimum combustion or after-burning in internal combustion engines. The installation provides for stabilization of the measuring receptivity of sensors employed for the measurement of the oxygen content or carbon monoxide content of the exhaust gases, and to reduce the load on a subsequently switched-in after-burner. Upstream of the sensor employed for the measurement of the oxygen content or carbon monoxide content of the exhaust gases, there is located a catalytically operative element for effecting the conversion of the deleterious materials into other harmless materials or compounds. The catalytically operative element may be combined in a unitary structure with a mixing chamber.

3 Claims, 1 Drawing Figure

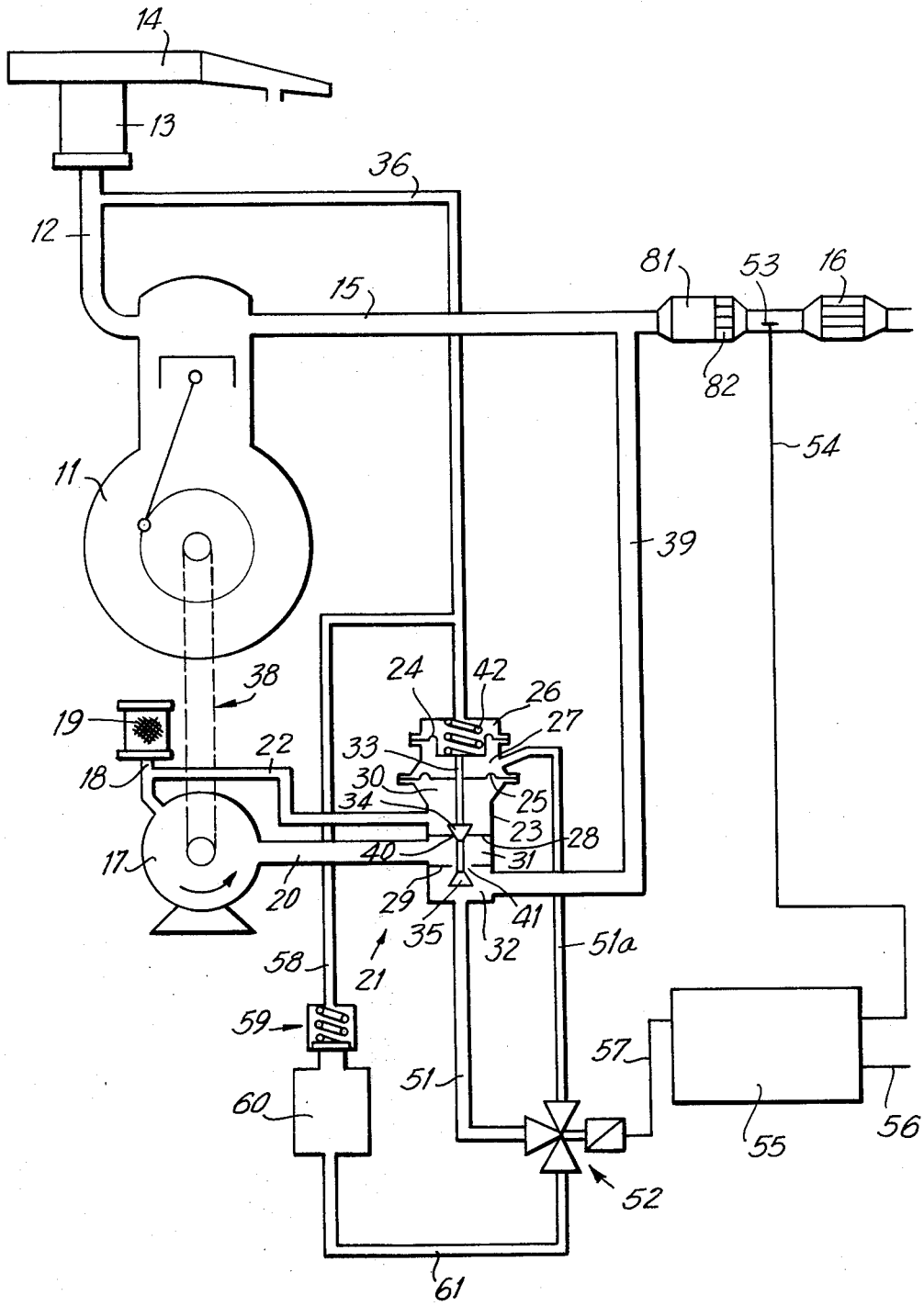
14
13
36
12
81
53
16
15
82
54
11
39
38
24
42
26
27
19
22
33
30
25
18
34
23
28
40
31
17
20
29
41
35
32
51a
58
21
59
57
51
60
55
56
52
61

CONTROL INSTALLATION FOR THE PROPORTIONING OF A SECONDARY AIR QUANTITY FOR ACHIEVING OPTIMUM COMBUSTION OR AFTER-BURNING IN INTERNAL COMBUSTION ENGINES

FIELD OF THE INVENTION

The present invention relates to a control installation for the measurement of a secondary air quantity employed for achieving optimum combustion or after-burning in internal combustion engines.

It has been ascertained as being necessary that the deleterious materials which are contained in the exhaust gases of internal combustion engines, such as carbon monoxide (CO), hydrocarbons ($C_xH_y$), and nitric oxide ($NO_x$), be converted through suitable means into harmless chemical compounds. In order to accomplish this effect, thermally and catalytically operating reactors or after-burners are generally utilized.

DISCUSSION OF THE PRIOR ART

When an internal combustion engine is driven under variable operative conditions, there occur constant changes in the composition of the exhaust gases. The foregoing changes disturb the after-burning sequence, inasmuch as at any particular time there is experienced an excess, and at another time, a shortage of oxygen available for use in the after-burning process. In order to compensate for these shortcomings, it is presently known that the internal combustion engines may be operated with a deficiency or insufficiency of air ( $\lambda$ is less than 1), and to introduce the combustion air required for the after-burning by means of a motor-driven air pump. An arrangement of that type is described and illustrated in German LAID-OPEN Specification No. 2,035,591.

A drawback of the prior art installations consists of in that the additive quantities of secondary air cannot be controlled in a precise and sufficiently rapid manner. Consequently, the after-burner cannot be optimally operated, and the deleterious materials in the exhaust gases cannot be adequately converted into harmless components.

In accordance with U.S. Pat. application No. 356,193; filed May 1, 1973 now U.S. Pat. No. 3,931,710 it has been proposed that the control installation include an arrangement for the withdrawal and reconveyance of a portion of the secondary air quantity which flows into the control installation, in which the quantity of the secondary air flowing into the control installation is dosed, in dependence upon the rotational speed of the internal combustion engine serving as the control parameter, by means of an air pump driven by the internal combustion engine, and wherein the quantity of the reconveyed secondary air is influenced by at least two further control parameters which are in a non-linear interdependent relationship with each other.

Pursuant to the above-mentioned patent application, employed as the guide or control parameters are, the pressure on the suction side (suction conduit pressure), the pressure on the exhaust side (exhaust gas back-pressure), the engine speed or R.P.M., the oxygen or the carbon monoxide content of the exhaust gases, either concurrently or selectively.

As a sensor for the measurement of the oxygen content or carbon monoxide content of the exhaust gases, there serves a measuring receiver having a platinum-coated wall or partition formed of zirconium oxide which is so located, whereby the wall on one surface thereof is in communication with the exhaust gas being measured, and on its other surface with the atmosphere.

In order that the control parameters may in themselves be further influenced, in the above-mentioned patent application it has additionally been proposed that adjusting elements be located in the signal conduits of one or more of the non-linear interdependent control parameters, and a signal transformer being suitably positioned between the sensor employed for the measurement of the oxygen content or carbon monoxide content of the exhaust gases and one or more of the adjusting elements which are located in the signal conduits of the non-linearly interdependent control parameters.

In accordance with the above-mentioned patent application, the after-burning takes place in an after-burner located downstream of the sensor employed for the measurement of the oxygen content or carbon monoxide content of the exhaust gases in an after-burner.

Since the individual cylinders of the internal combustion engine are generally driven with various or different values of the air-fuel relationship, it becomes unwieldly and difficult to rapidly and sufficiently accurately control the secondary air quantity in order to be able to obtain optimum after-burning.

SUMMARY OF THE INVENTION

Accordingly, it is an object of the present invention to provide for stabilization of the measuring receptivity of the sensors employed for the measurement of the oxygen content or carbon monoxide content of the exhaust gases, and to reduce the load on the subsequently switched-in after-burner.

In accordance with the invention, the foregoing object is inventively achieved in that, upstream of the sensor employed for the measurement of the oxygen content or carbon monoxide content of the exhaust gases, there is located a catalytically operative element for effecting the conversion of the deleterious materials into other materials or compounds.

For this purpose, the operative surface of the catalytically operative element suitably is considerably smaller than the operative surface of the after-burner which is located downstream of the sensor.

In order to effect the further stabilization of the measuring receptivity, it is also inventively proposed that the catalytically operative element be combined in a unitary structure with a mixing chamber.

The advantages obtained by means of the present invention particularly consist of in that the operative precision of the sensor for the measurement of the oxygen content or carbon monoxide content is considerably enhanced, since it operates at a higher temperature and, consequently, in the range of lower oxygen or, respectively, carbon monoxide concentrations, so that the sensor may be smaller dimensioned, while the measuring reception is stabilized and, concurrently, the load reduced on the subsequently switched-in after-burner.

BRIEF DESCRIPTION OF THE DRAWING

Reference may now be had to an exemplary embodiment of a control installation constructed pursuant to the invention, taken in conjunction with the accompanying single FIGURE of the drawing.

DETAILED DESCRIPTION

An internal combustion engine 11 includes a suction conduit 12 on the suction side thereof, having a carburetor 13 fastened at one end thereof. The air inlet is effected through the air filter 14. The fuel inlet and air-fuel mixture forming arrangements of the carburetor are not illustrated.

At its exhaust side, internal combustion engine 11 includes an exhaust gas collecting conduit 15, which leads to an after-burner 16 through a whirling or mixing chamber 81 and a catalytically operative element 82, which is integrally constructed with the mixing chamber 81. The element 82 and chamber 81 may be of a conventional construction similar to that disclosed in U.S. Pat. No. 3,723,070 issued Mar. 27, 1973 in which a precatalyzor is provided with a chamber to act as a mixing chamber. An air pump 17 is connected with a filter 19 through the suction conduit 18, across which secondary air is aspirated from the atmosphere. A conduit 20 leads from the air pump 17 to a control installation 21. An air return conduit 22 leads from the control installation 21 back into the suction conduit 18.

The control installation 21 includes a multiple-component housing 23 which is divided, through the intermediary of membranes 24 and 25 into control pressure chambers 26 and 27, and through partitions 28 and 29, into pressure chambers 30, 31 and 32. The conduit 20 communicates with the pressure chamber 31, and the air return conduit 22 with the pressure chamber 30.

The membrane 25 has a larger operative surface than the membrane 24. Both membranes are fixedly connected to a control rod 33 which has conical measuring valves 34 and 35 mounted thereon in a superimposed relationship. The conical measuring valves operate in conjunction with passages 40 and 41 which are provided in the separating walls 28 and 29.

Utilized as the non-linearly interdependent control parameters are the suction conduit pressure, the exhaust gas back-pressure and the engine speed or R.P.M. The suction conduit pressure is communicated into the control installation 21 through conduit 36, and the exhaust back-pressure through conduit 37. The engine R.P.M. or rotational speed is similarly transmitted into the control installation 21 through a drive 38 directly to the air pump 17, and indirectly through the rotational speed-dependent operating air quantity, by means of conduit 20. The secondary air is introduced through conduit 39 into the exhaust gas collecting conduit 15.

In the engine stationary operating mode, both conical measuring or calibrating valves are moved into their lowermost position due to the force of a compression spring 42 acting on membrane 24, so as to close aperture 40 and completely open aperture 41.

During engine operation the air pump 17 pumps, in response to a predetermined engine R.P.M., a correspondingly larger or smaller air quantity. At a high suction conduit pressure, compression spring 42 is unloaded, in view of which the conical valves are downwardly displaced. Consequently, the return flow of secondary air from pressure chamber 31 into the pressure chamber 30 and from there into the air return conduit 22 is either reduced or completely stopped, whereas the aperture 41 is more or less opened so as to allow for the passage therethrough of secondary air from pressure chamber 31 into the pressure chamber 32 and from the latter through conduit 39 into the exhaust gas collecting conduit 15. The lower the suction tube pressure, the higher are conical valves 34 and 35 raised, so as to permit that much more air to be returned, while restricting the delivery of secondary air.

In a signal conduit 51; 51a for which the control installation 21 employs the exhaust gas back-pressure as the control parameter, there is utilized a control element 52 which is constituted of an electro-magnetically actuated three-way valve. The withdrawal of the exhaust gas back-pressure is obtained from the pressure chamber 32.

In view of the area of surface differential of membranes 24 and 25, an increasing exhaust gas back-pressure creates an increased opening, whereas a reducing exhaust gas back-pressure created the continued closing of aperture 41.

Upstream of the after-burner 16, a sensor 53 is located in the exhaust gas collecting conduit 15 so as to facilitate the measurement of the oxygen content in the exhaust gases. The sensor consists of a measured value receiver which includes a platinum-coated wall formed of zirconium oxide. The measured value receiver is positioned so that the wall communicates with one surface thereof with the exhaust gases being measured, and its other surface with the atmosphere.

The sensor 53 conveys a voltage signal, dependent upon the measured oxygen content of the exhaust gases, through an electrical conduit 54 into a signal converter or transformer 55. The signal converter 55, by means of a conduit 56 and a suitable accumulator battery (not shown), has an operative direct current supplied thereto. The signal converter 55 emanates a variable output signal which is conveyed through a conduit 57 to the control element 52.

A signal conduit 58 branches from conduit 36 and similarly leads through a non-return valve 59, a reserve container 60 and a signal conduit 61, to control element 52. The control element 52 is in a position to, in accordance with the received impulse signals, to connect, with variable interruption intervals, the signal conduit 51a with either the signal conduit 51 or 61. In dependence upon the interruption intervals, a predetermined pressure is generated in the control pressure chamber 27, so as to effect a precise regulation on the considerably differently sized operative surfaces of the membranes 24 and 25.

The foregoing components, with the exception of mixing chamber 81 and catalytically operative element 82, are generally similar to those utilized in applicant's U.S. Pat. No. 3,931,710.

In addition to the above-enumerated advantages of the present invention it is also emphasized that in view of the inventive fine precision control over the addition of secondary air, the conversion of the deleterious materials which are contained in the exhaust gases of the internal combustion engine are adapted to be converted to an optimum extent into harmless components for the purposes of environmental protection.

While there has been shown what is considered to be the preferred embodiment of the invention, it will be obvious that modifications may be made which come within the scope of the disclosure of the specification.

What is claimed is:

1. An installation for the proportionate addition of secondary air employed in the optimum after-burning of the exhaust gases of an internal combustion engine, including; an engine-driven air pump, control means for introducing predetermined quantities of said secondary air; means located externally of said control means being responsive to at least one of a plurality of engine operating conditions consisting of the pressure of the engine suction side, the engine exhaust gas back-pressure, engine rotational speed, exhaust gas oxygen content, and exhaust gas carbon monoxide content for regulating said control means; said control means including means for the withdrawal of a portion of the secondary air conveyed through said control means and conducting said withdrawn secondary air to the suction side of said air pump, said air pump returning said secondary air from the pressure side of said air pump to said control means; means for determining the rate of feed of the secondary air and the quantity of the air portion withdrawn from said control means to said air pump, said means including two spaced conical valve means controlling flow passages through said control means, said valve means being mounted on a common actuating control rod and being positioned so that, during an increase of the fed quantity of second air, the quantity of the withdrawn air portion is reduced, said actuating control rod for said conical valve means being rigidly connected to two spaced upper and lower membranes having unequal operative surfaces, said membranes defining therebetween a first control pressure chamber communicating with the exhaust gas back-pressure of said engine, and a second control pressure chamber located above the upper membrane communicating with the suction side pressure of said engine, the improvement comprising: sensor means for measuring the oxygen content or carbon monoxide content in the exhaust gas; a catalytically operative element being positioned upstream of said sensor means for converting deleterious materials in said exhaust gas into other harmless materials.

2. Control installation as claimed in claim 1, comprising after-burner means positioned downstream of said sensor means.

3. Control installation as claimed in claim 1, comprising a mixing chamber connected with said catalytically operative element.

* * * * *